US010228185B2

(12) United States Patent
Cizik et al.

(10) Patent No.: US 10,228,185 B2
(45) Date of Patent: Mar. 12, 2019

(54) ASSEMBLY FOR A DOMESTIC REFRIGERATION APPLIANCE WITH A WIRE BASKET AND DOMESTIC REFRIGERATION APPLIANCE WITH SUCH AN ASSEMBLY

(71) Applicant: BSH-HAUSGERAETE GMBH, Munich (DE)

(72) Inventors: Herbert Cizik, Ottenbach (DE); Jessica Dittmann, Lauchheim (DE); Daniel Bassler, Aalen (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/835,547

(22) Filed: Dec. 8, 2017

(65) Prior Publication Data

US 2018/0172340 A1 Jun. 21, 2018

(30) Foreign Application Priority Data

Dec. 15, 2016 (DE) ..... 10 2016 225 086

(51) Int. Cl.
*F25D 25/02* (2006.01)
*F25D 11/00* (2006.01)
*F25D 23/06* (2006.01)

(52) U.S. Cl.
CPC ..... *F25D 25/022* (2013.01); *F25D 11/00* (2013.01); *F25D 25/024* (2013.01); (Continued)

(58) Field of Classification Search
CPC .... F25D 25/022; F25D 25/024; F25D 25/025; F25D 11/00; F25D 23/067; A47B 2210/0024; A47B 2088/401; A47B 2210/04; A47B 88/402; A47B 88/43; A47B 2210/0059; A47B 88/423; A47B 2210/09; A47L 15/507; A47L 15/504; A47L 15/502; A47L 15/50; A47L 15/0084; A47L 15/501; A47L 15/506; F16B 12/38; F16B 7/0433; Y10T 24/44923; Y10T 24/344; Y10T 24/44769; Y10T 403/7176; Y10T 24/44752; Y10T 403/3906
See application file for complete search history.

(56) References Cited

U.S. PATENT DOCUMENTS 4,449,765 A * 5/1984 Lampman ..... A47L 15/507 16/267
7,410,228 B2 * 8/2008 Dickson ..... A47L 15/504 211/41.9

(Continued)

FOREIGN PATENT DOCUMENTS

DE 102007021555 A1 11/2008

*Primary Examiner* — Hiwot E Tefera
(74) *Attorney, Agent, or Firm* — Laurence A. Greenberg; Werner H. Stemer; Ralph E. Locher

(57) ABSTRACT

An assembly for a domestic refrigeration appliance includes a wire basket and at least one pull-out rail apparatus connected to the wire basket. The pull-out rail apparatus has a coupling unit which engages at least partially around at least one wire of the wire basket oriented in a first direction and engages at least partially around one wire of the wire basket oriented in a second direction that is different than the first direction. A domestic refrigeration appliance is also provided.

10 Claims, 5 Drawing Sheets

(52) U.S. Cl.
CPC .... *F25D 25/025* (2013.01); *A47B 2210/0059* (2013.01); *F25D 23/067* (2013.01)

(56) References Cited

U.S. PATENT DOCUMENTS

| | | | | |
|---|---|---|---|---|
| 8,840,201 | B2 * | 9/2014 | Garnett | A47L 15/504 312/228.1 |
| 9,004,082 | B2 * | 4/2015 | Bhajak | A47L 15/504 134/135 |
| 9,107,563 | B2 * | 8/2015 | Ryu | A47L 15/507 |
| 9,462,930 | B2 * | 10/2016 | Bastuji | A47L 15/507 |
| 9,596,931 | B1 * | 3/2017 | Nimgulkar | A47B 88/08 |
| 2001/0044992 | A1 * | 11/2001 | Jahrling | A47B 55/02 24/563 |
| 2002/0125802 | A1 * | 9/2002 | Remmers | A47B 88/402 312/334.7 |
| 2005/0001524 | A1 * | 1/2005 | Deiss | A47L 15/504 312/334.4 |
| 2008/0054772 | A1 * | 3/2008 | Koloff | F25D 25/024 312/404 |
| 2008/0272072 | A1 * | 11/2008 | Tynes | A47L 15/504 211/41.8 |
| 2010/0018242 | A1 * | 1/2010 | Kim | F25D 25/022 62/465 |
| 2011/0018410 | A1 * | 1/2011 | Bastuji | A47L 15/504 312/228.1 |
| 2014/0217868 | A1 * | 8/2014 | Bhajak | A47L 15/50 312/228.1 |
| 2015/0173588 | A1 * | 6/2015 | Bhajak | A47L 15/504 312/228.1 |
| 2016/0331204 | A1 * | 11/2016 | Kutto | A47L 15/504 |
| 2017/0245727 | A1 * | 8/2017 | Blanchard | A47L 15/16 |

* cited by examiner

ASSEMBLY FOR A DOMESTIC REFRIGERATION APPLIANCE WITH A WIRE BASKET AND DOMESTIC REFRIGERATION APPLIANCE WITH SUCH AN ASSEMBLY

CROSS-REFERENCE TO RELATED APPLICATION

This application claims the benefit, under 35 U.S.C. § 119, of German Patent Application DE 10 2016 225 086.8, filed Dec. 15, 2016; the prior application is herewith incorporated by reference in its entirety.

BACKGROUND OF THE INVENTION

Field of the Invention

The invention relates to an assembly for a domestic refrigeration appliance including a wire basket which is configured to hold food to be stored in the domestic refrigeration appliance. The invention also relates to a domestic refrigeration appliance with such an assembly.

In domestic refrigeration appliances, such as for example a refrigerator or a freezer or a combined refrigerator/freezer appliance, many different embodiments of containers are known, in which food can be placed and thus be moved into a receiving chamber of the domestic refrigeration appliance. Closed boxes are known for that purpose. Trays are also known, which have unbroken and therefore uninterrupted continuous and therefore uniform walls as boundaries. One possible disadvantage of such configurations is that in some instances the circulation of air is compromised and therefore air cannot flow adequately around items stored in the lower region of such a container. That can impact disadvantageously on the shelf life of the food. It is also possible with containers that are closed at the walls in that manner for liquid, for example condensed water or liquid from the stored items themselves, to collect in the container and also have a negative effect on the stored items.

Such disadvantages can be eliminated with containers configured as wire baskets. Such a wire basket is known for example from German Patent Application DE 10 2007 021 555 A1.

SUMMARY OF THE INVENTION

It is accordingly an object of the invention to provide an assembly for a domestic refrigeration appliance with a wire basket and a domestic refrigeration appliance with such an assembly, which overcome the hereinafore-mentioned disadvantages of the heretofore-known assemblies and appliances of this general type and with which the repositioning and handling required for this purpose are also easier for a user.

With the foregoing and other objects in view there is provided, in accordance with the invention, an assembly for a domestic refrigeration appliance, comprising a container for food in the form of a wire basket. It is an important concept of the invention that the assembly has a pull-out rail apparatus, which is connected to the wire basket so that the wire basket can be moved continuously in the domestic refrigeration appliance. The pull-out rail apparatus has a coupling unit, which engages at least partially around at least one wire of the wire basket oriented in a first direction. The coupling unit also engages at least partially around a wire of the wire basket oriented in a second direction that is different from the first direction. This configuration on one hand allows the wire basket to be handled easily and to be moved without difficulty into different continuous positions. As a result it can be easily pulled out of a receiving chamber of a domestic refrigeration appliance, so that items to be stored can be placed in and taken out of the wire basket particularly easily. One very significant advantage of the inventive assembly in this context is that the presence of such a pull-out rail apparatus forms a mechanically stable fastening to the wire basket. Since the structure of such a wire basket means that it is formed from different wires and is therefore configured completely differently from for example solid plastic trays, the fastening of the pull-out rail apparatus to the wire basket is a task that also has to be resolved appropriately. Stable and wobble-free fastening is a particular challenge precisely because of the individual and fewer connection points on a wire basket. The invention resolves this in a particularly ingenious manner in that the coupling unit is coupled mechanically to at least two wires with different orientations, thereby achieving a stable and securely positioned connection. Provision is preferably made for the coupling unit to be configured as a single piece. This means that it has a minimum number of parts and can be fastened particularly easily to the wires of the wire basket. Removal can also take place quickly and in the required manner.

Provision is preferably made for the coupling unit to have a first channel, in which the first wire runs embedded when the coupling unit is mounted on the wire basket. This, as it were, lowered position of the first wire in the first channel of the coupling unit also allows a particularly compact configured to be achieved in addition to a mechanically stable connection.

The channel thus predefines a receiving track or mounting track, in which the first wire can be held over a desired length of the channel, thereby providing more than local connecting points. This even more significantly increases fastening stability.

Provision is preferably made for the first channel to have a channel opening running in the direction of the channel axis of the first channel—and thus in particular parallel to the channel axis—with the channel opening being wider than the diameter of the first wire. Such a configuration allows easy mounting and removal, since the first wire can then be suspended in the specifically geometrically configured first channel. No further additional locking mechanism is then provided in this case but a high level of secure positioning is still achieved.

Provision is preferably made for the coupling unit to have a second channel, in which the second wire runs embedded when the coupling unit is mounted on the wire basket. The second channel has a channel opening running in the direction of the channel axis—and thus in particular parallel to the channel axis—with the channel opening being narrower in the circumferential direction around the channel axis than the diameter of the second wire. Such a specification not only allows the second wire to be suspended in the second channel, it also allows additional clipping or latching in place. This is a further, particularly advantageous embodiment, since it prevents the second wire from slipping out in an unwanted manner and the position of the coupling unit on the wire basket is particularly well secured.

Provision is preferably made for the second wire to be latched into the second channel.

In one advantageous embodiment, provision is made for the channel opening of the second channel to be delimited by elastic wings. This also allows insertion of the second wire in a simple manner, since the elastic wings can move to the side and then move back together when the second wire is pushed into the second channel, thereby defining the narrower channel opening. A self-locking and retaining mechanism is thus created in this case.

It is particularly advantageous that such an option for fastening the coupling unit to the wire basket on at least two differently oriented wires also allows the coupling unit to be attached to the wire basket in varying positions. Since the wires of the wire basket oriented in one direction generally run parallel to one another and a type of cross pattern or matrix pattern is created with the otherwise oriented wires and the gaps between the wires running parallel to one another are in particular identical in this case, the coupling unit can be mounted at different points on the wire basket.

Such a configuration of a coupling unit and its manner of fastening to the wire basket also particularly advantageously mean that it is no longer necessary to use additional fastening elements, such as screws or the like. Additional fastening plates, such as sheets, which then have to be screwed in place, are also no longer necessary in this case. Such suspension and latching of the coupling unit to the wire basket allows very fast mounting with specific and securely positioned attachment. This configuration and the assembly with a minimum number of parts also allow a weight reduction due to the fact that a number of parts, in particular metal parts, can be dispensed with.

At least two second channels oriented parallel to one another are preferably provided on the coupling unit, with a first channel crossing the two second channels. This creates a particularly secure mechanical connection, which does not become detached in an unwanted manner, while still allowing a high level of secure positioning.

Provision is preferably made for the coupling unit to have a counter-stop, which is adjacent one side of a wire, when the coupling unit is mounted on the wire basket, with that side being opposite a side of a wire to which a channel is adjacent. This allows the wire basket to be, as it were, clamped to the coupling unit, since a wire is present in the channel on the one side, supported by or in contact with the wall delimiting the channel. The separate counter-stop then is adjacent the wire or a different wire opposite the channel wall on the other side. The counter-stop is in particular formed as a straight strip. It can preferably also be elastic. This makes engagement or contact with the wire particularly simple and mechanically very stable.

The wires of the wire basket are preferably disposed crosswise to one another and the wires are connected to one another at crossing points. This makes the wire basket very stable and the forces resulting from the mounting of the coupling unit do not cause the wires to change position relative to one another in an unwanted manner, allowing the coupling unit to be connected securely to the wire basket in a mechanically stable manner. The forces acting on and transmitted to the wire basket when it is pulled out and pushed in can also be absorbed reliably and sustainably as a result.

With the objects of the invention in view, there is concomitantly provided a domestic refrigeration appliance comprising a housing, in which at least one receiving chamber for food is formed. The domestic refrigeration appliance also has an assembly according to the invention or an advantageous configuration thereof. The assembly is disposed in the receiving chamber and the assembly allows the wire basket to be pulled out of the receiving chamber and pushed back in. The domestic refrigeration appliance can be a refrigerator or a freezer or a combined refrigerator/freezer appliance and can be configured to store and preserve foods.

The coupling unit, which can also be referred to as an adapter part, is preferably made of plastic, allowing it to be manufactured very easily in the form of an injection molded part of greatly reduced weight. Such a material configuration also means that it is particularly suitable for use in a domestic refrigeration appliance, with the coupling unit being exposed to different temperatures and/or different air humidity values.

The terms "top," "bottom," "front," "rear, "horizontal," "vertical," "depthwise direction," "widthwise direction," "heightwise direction," etc. indicate the positions and orientations defined when the appliance is used and disposed correctly and for an observer standing in particular in front of the appliance and looking in the direction of the appliance.

Further features of the invention will emerge from the claims, the figures and the description of the figures. The features and feature combinations mentioned above in the description and the features and feature combinations mentioned below in the description of the figures and/or simply illustrated in the figures can be used not only in the combination specified in each instance but also in other combinations without departing from the scope of the invention. Embodiments of the invention not specifically illustrated and described in the figures but which emerge and can be produced from the described embodiments by using separate feature combinations should therefore also be considered to be included and disclosed. Embodiments and feature combinations which therefore do not have all the features of an originally formulated independent claim should also be considered to be disclosed. Embodiments and feature combinations which go beyond or deviate from the feature combinations set out in the claim references should also be considered to be disclosed, in particular by the embodiments set out above.

Other features which are considered as characteristic for the invention are set forth in the appended claims.

Although the invention is illustrated and described herein as embodied in an assembly for a domestic refrigeration appliance with a wire basket and a domestic refrigeration appliance with such an assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
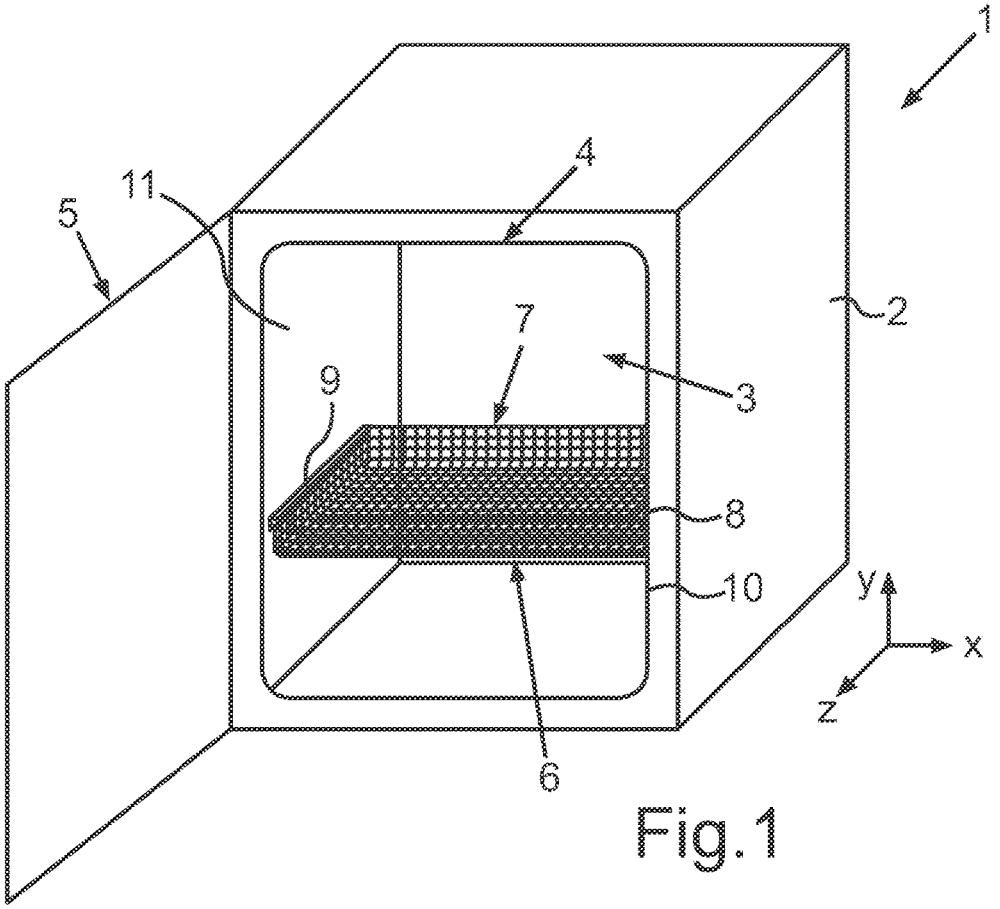
FIG. 1 is a diagrammatic, perspective view of an exemplary embodiment of a domestic refrigeration appliance according to the invention.

Referring now in detail to the figures of the drawings, in which identical elements or those of identical function are shown with identical reference characters, and first, particularly, to FIG. 1 thereof, there is seen a domestic refrigeration appliance 1, which can be a refrigerator or a freezer or a combined refrigerator/freezer appliance. Food can be stored in the domestic refrigeration appliance 1. The domestic refrigeration appliance 1 includes a housing 2 in which at least one receiving chamber 3 for holding food is configured. In particular, in the illustrated exemplary embodiment the receiving chamber 3 can be a refrigeration compartment or a freezer compartment. The receiving chamber 3 is delimited by walls of an inner container 4. The inner container 4 has a loading opening at the front, which can be closed by a door 5. The door 5 is disposed on the housing 2 in a pivotable manner.

Disposed in the receiving chamber 3 is an assembly 6, which is a container in the form of a wire basket 7 for chilled goods to be stored. The assembly 6 also includes pull-out rail apparatuses 8 and 9. The pull-out rail apparatuses 8 and 9 are in particular telescopic pull-out extensions. The first pull-out rail apparatus 8 is disposed on a first vertical side wall 10 of the inner container 4 and the second pull-out rail apparatus 9 is disposed on an opposing second vertical side wall 11 of the inner container 4. The pull-out rail apparatuses 8 and 9 are oriented in the depthwise direction (z direction) of the domestic refrigeration appliance 1 in such a way that the wire basket 7 connected thereto can be pushed into the receiving chamber 3 and pulled out again therefrom in the depthwise direction.

Figure 2:
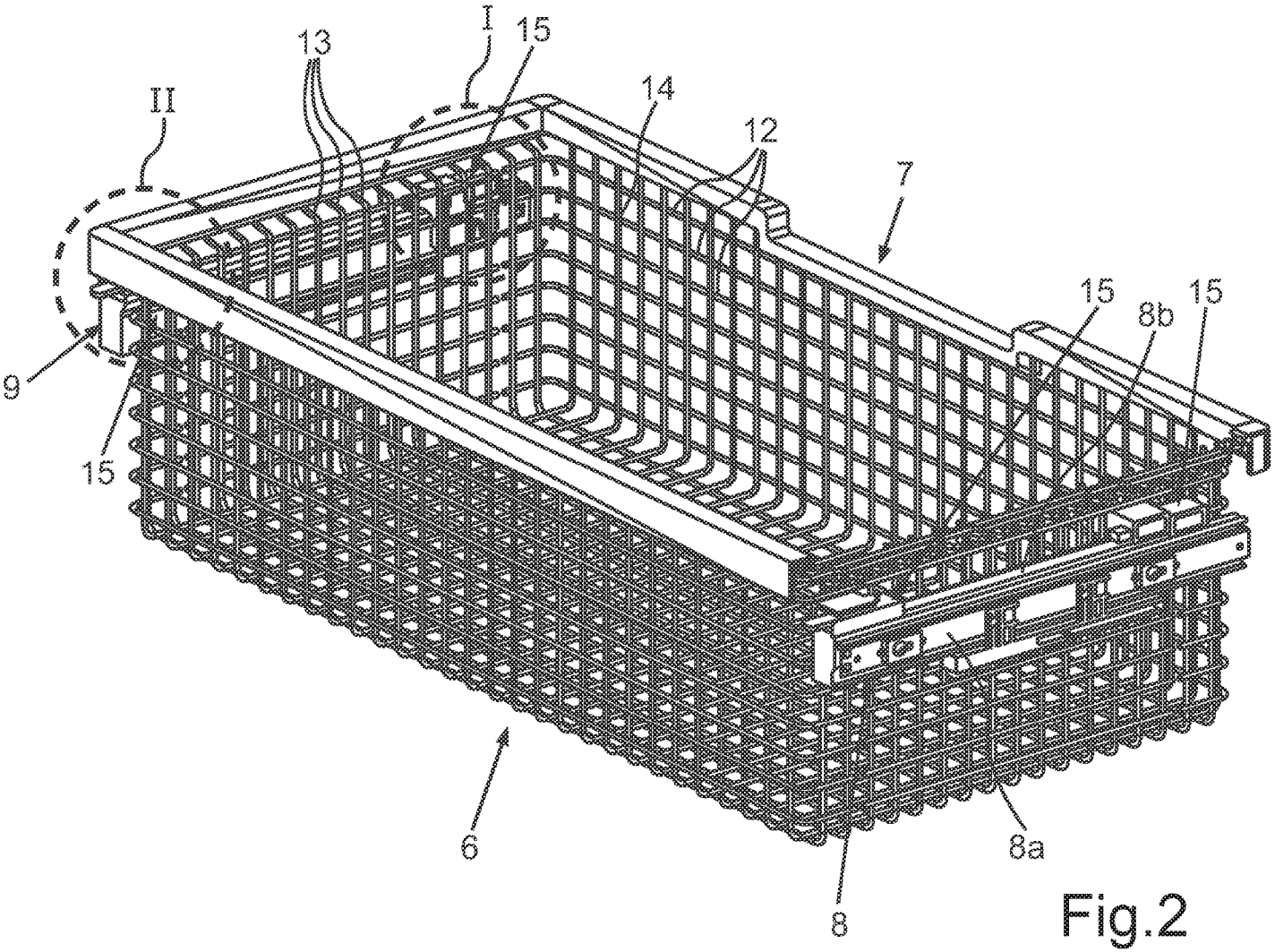
FIG. 2 is a perspective view of an exemplary embodiment of an assembly according to the invention.

The wire basket 7 is configured in the manner of a trough. FIG. 2 shows an enlarged view of the assembly 6. It can be seen that the wire basket 7 is constructed from a plurality of wires including first wires 12 which are oriented horizontally on delimiting walls of the wire basket 7 oriented in the heightwise direction (y direction). The plurality of first wires 12 run parallel to and at a distance from one another. The wire basket 7 also includes second wires 13, which are oriented in a heightwise direction on delimiting walls or wire walls of the wire trough or wire basket 7 oriented in the heightwise direction and thus in they direction. The second wires 13 are again disposed similarly parallel to and at a distance from one another. As far as orientation is concerned, the first wires are also seen on the wire walls of the wire basket 7 oriented in the upward direction.

It can also be seen that the first wires 12 and the second wires 13 cross one another at a number of crossing points. Only one crossing point 14 is indicated with a reference character to show the actual position thereof. In particular, the wires 12 and 13 are connected, in particular welded or bonded, to one another at the respective crossing points 14.

The first wires 12 in this case are oriented in a first direction, in this instance the horizontal direction. The second wires 13 are oriented in a second direction, in this instance the upward direction or heightwise direction and therefore in particular a vertical direction.

The pull-out rail apparatus 8 is fastened by way of a coupling unit 15 to the wire basket 7. The coupling unit 15 has two separate sub-units. The pull-out rail apparatus 8 is thus fastened at a front end and a rear end to two points on the wire basket 7, in particular to a wire wall of the wire basket 7 oriented in an upward direction. The pull-out rail apparatus 8 in this case includes a fixed rail 8*a* and a running rail 8*b*, the fixed rail 8*a* being fastened to the side wall 10 in a fixed position and the running rail 8*b* in turn being fastened to the wire basket 7 in a fixed position by way of the coupling unit 15. The same provision is made for the pull-out rail apparatus 9.

Figure 3:
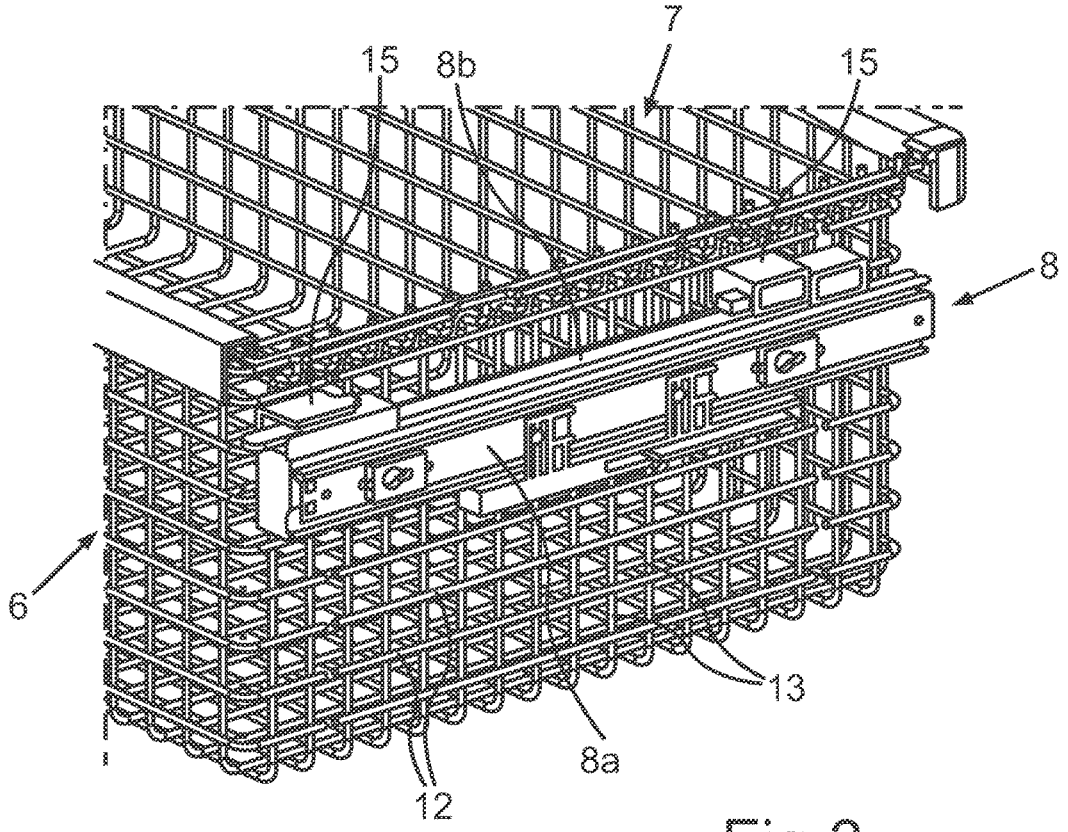
FIG. 3 is an enlarged, fragmentary, perspective view of a sub-region of the assembly according to FIG. 2.

FIG. 3 shows an enlarged view of the assembly 6 in the region of the pull-out rail apparatus 8.

Figure 4:
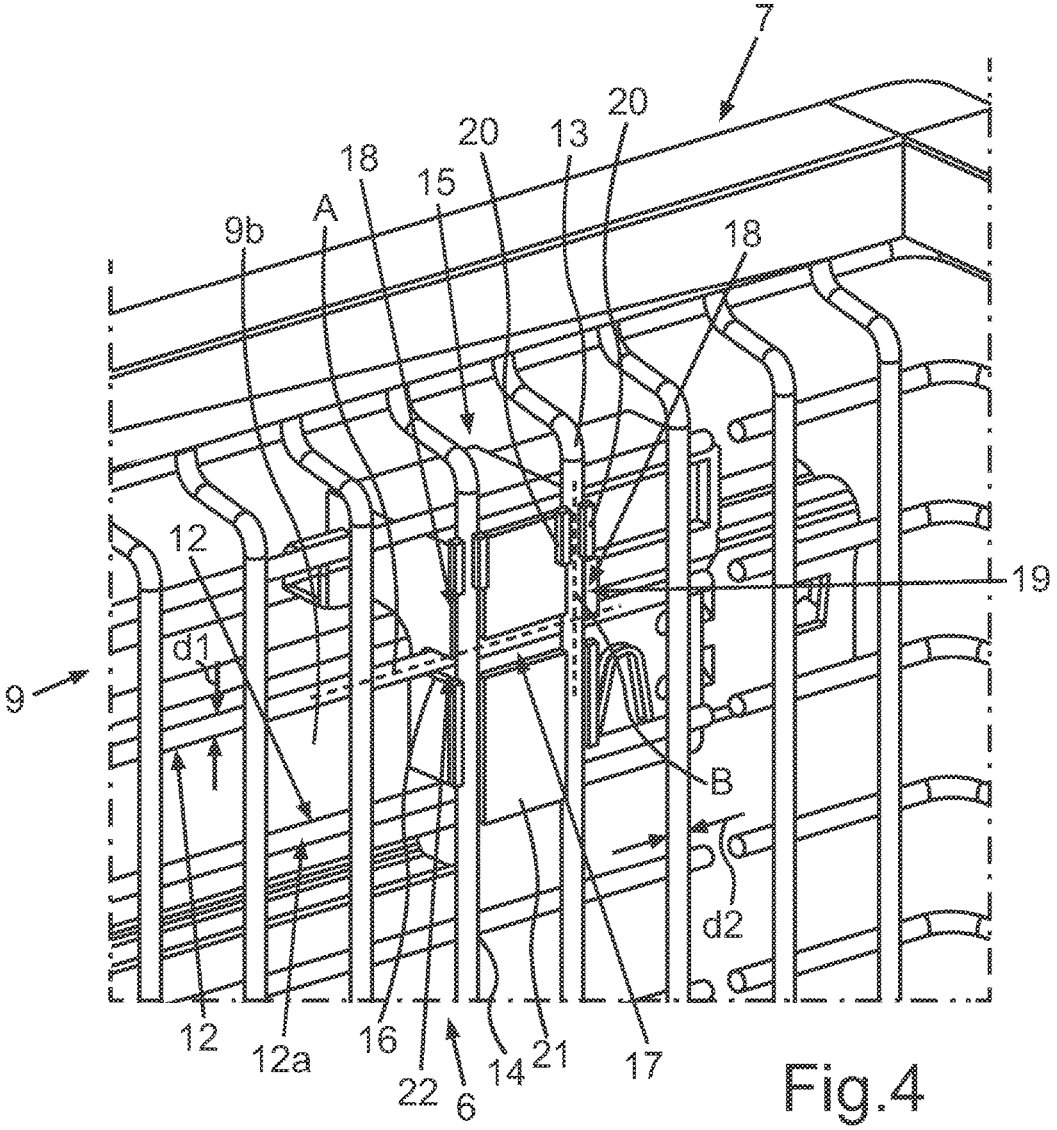
FIG. 4 is a further enlarged, fragmentary, perspective view of a further sub-region of the illustration according to FIG. 2.

FIG. 4 shows an enlarged view of a sub-region I of the assembly 6 in FIG. 2. The view in this case is from the interior of the wire basket 7 toward the rear sub-unit of the coupling unit 15. Like the first pull-out rail apparatus 8, the second pull-out rail apparatus 9 also includes a running rail and a fixed rail. FIG. 4 showing the running rail 9*b* and FIG. 5 also shows the fixed rail 9*a*.

In FIG. 4 the coupling unit 15, which is configured as a separate adapter, has a first channel 16, in which a first wire 12 is disposed when the coupling unit 15 is mounted on the wire basket 7. The first wire 12 in this case runs so as to be embedded over a certain distance in the first channel 16, in particular it is completely lowered into the first channel 16.

The first channel 16 has a channel axis A. A channel opening 17 running in the direction of the channel axis A of the first channel 16 is wider, when viewed in the circumferential direction around the channel axis A, than a diameter d1 of the first wire 12. The first wire 12 is therefore, as it were, simply suspended in this first channel 16 but is not latched or clipped therein.

The coupling unit 15 also has at least one second channel 18. In the exemplary embodiment, two second channels 18 are provided. When the coupling unit 15 is mounted on the wire basket 7, a second wire 13 is disposed, in particular disposed to run so as to be embedded, in a second channel 18. The second channel 18 has a channel opening 19 running in the direction of a channel axis B. The channel opening 19 has an opening width narrower than a diameter d2 of the second wire 13 over at least part of the length of the second channel 18 measured in the direction of the channel axis B. The second channel 18 has two wings 20 that are in particular elastic and disposed at a distance from one another at a narrow point. This forms a corresponding narrow point, through which the second wire 13 must be pushed and thus be clipped or latched in the second channel 18.

The second channel 18 is also configured in the same manner as the first channel 16 over a further distance in the illustrated exemplary embodiment, so that the second wire 13 is simply suspended and not clipped or latched in over this further distance.

The coupling unit 15 also preferably has a counter-stop 21. This counter-stop 21 is located opposite the channels 16 and 18, so that in the mounted state the counter-element or counter-stop 21 is adjacent one side 12*a* of the first wire 12, which faces away from a channel 16, 18 or the side 12*a* faces the channel opening 17 or the channel opening 19. The side 12*a* of a wire 12 is therefore not in contact with a surface delimiting a channel 16 or 18.

These opposing contact points, on one side the counter-element or counter-stop 21, on the other side a wall delimiting a channel 16 or 18, bring about a two-sided fastening in particular on two different wires of a first category, in particular on two different first wires 12. On one side the counter-stop 21 acts on a first side 12*a* of a first wire 12, on the other side a wall delimiting the first channel 16 acts on a further different side of a different first wire 12, producing a certain two-sided clamping action, which fastens the coupling unit 15 to the wire weave of the wire basket 7.

It can also be seen in this case that the fastening of the coupling unit 15 to at least two differently oriented wires 12 and 13 of the wire basket 7 is achieved simply by using the above-described connections and no further separate fastening elements, such as screws or the like, are required.

Figure 5:
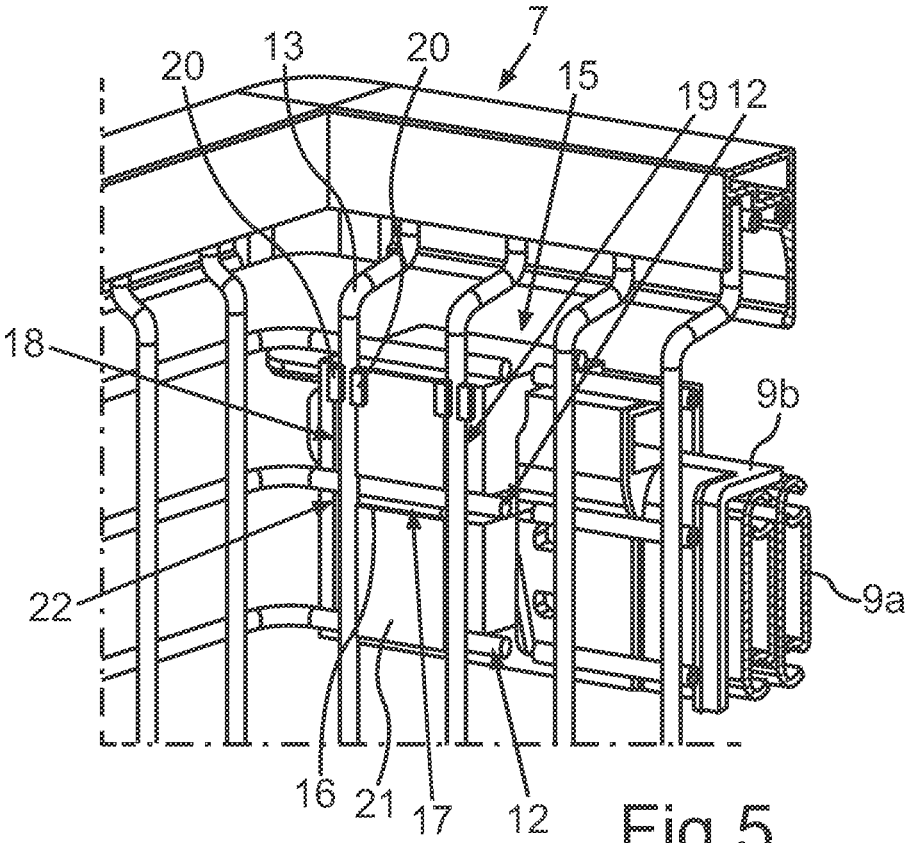
FIG. 5 is an even further enlarged, fragmentary, perspective view of a sub-region of the assembly according to FIG. 2.

FIG. 5 shows a further enlarged view of the sub-region II in FIG. 2 and thus a front sub-unit of the coupling unit 15. A mechanical connection is produced in this case too, as configured in the sub-unit of the coupling unit 15 and described in relation to FIG. 4.

It can also be seen that a first channel 16 crosses at least one second channel 18, in particular two second channels 18.

The channels 16 and 18 are oriented in particular perpendicular to one another, which is also the case in particular for the layout of the wires 12 and 13 in relation to one another. As a result a crossing point 14 between a first wire 12 and a second wire 13 is also disposed so as to be lowered or embedded in a crossing point between the first channel 16 and a second channel 18 at such a channel crossing. Such a crossing point or channel crossing 22 is shown in FIG. 5.

Provision is made in particular for a mounting for the counter-stop 21 of the coupling unit 15 to be pushed first behind a first wire 12 and then to be positioned thereon from above. A pivoting movement then causes the coupling unit 15 to pivot against the wire wall of the wire basket 7, which is oriented in the upward direction, so that a first wire 12 disposed above it enters the first channel 16 and then for final mounting the second wires 13 also enter the second channels 18 completely and pressure is applied by way of the upper connecting points located opposite the counter-stop 21 in the heightwise direction and formed by the elastic wings 20, so that the second wires 13 latch therein. This results in the mounted final state. The counter-stop 21 is a plate-like strip, which covers a groove, with the groove opening at the bottom when viewed in the heightwise direction, so that it is possible to suspend the coupling unit 15 and rest it on a first wire 12 oriented horizontally in this manner, thus allowing a secure intermediate mounting position to be reached during mounting, from which the pivoting of the coupling unit 15 relative to the wire basket 7 can be completed in order for the further first wire 12 disposed above it to be lowered or suspended in the first channel 16 and the vertically oriented second wires 13 to be clipped or snapped or latched into the second channels 18.

The channels 16, 18 engage partially, in particular engage only partially in each instance, around the wires 12, 13 held therein in the circumferential direction around the channel axes A, B.

The following is a summary list of reference numerals and the corresponding structure used in the above description of the invention:

1 Domestic refrigeration appliance
2 Housing
3 Receiving chamber
4 Inner container
5 Door
6 Assembly
7 Wire basket
8 Pull-out rail apparatus
8*a* Fixed rail
8*b* Running rail
9 Pull-out rail apparatus
9*a* Fixed rail
9*b* Running rail
10 First vertical side wall
11 Second vertical side wall
12 First wires
12*a* Side
13 Second wires
14 Crossing point
15 Coupling unit
16 First channel
17 Channel opening
18 Second channels
19 Channel opening
20 Wing
21 Counter-stop
22 Channel crossing
d1 Diameter
d2 Diameter
A Channel axis
B Channel axis

The invention claimed is:

1. An assembly for a domestic refrigeration appliance, the assembly comprising:

a wire basket having first wires oriented in a first direction and second wires oriented in a second direction being different than the first direction, said first wires having a diameter; and at least one pull-out rail apparatus connected to said wire basket, said at least one pull-out rail apparatus having a coupling unit engaging at least partially around one of said first wires oriented in said first direction and engaging partially around one of said second wires oriented in said second direction;

said coupling unit having a first channel in which said first wire runs and is embedded when said coupling unit is mounted on said wire basket, said first channel having a channel axis running along a first channel axis direction, said first channel having a first channel opening running in said first channel axis direction, said first channel opening being wider than said diameter of said first wire;

said coupling unit having at least two second channels oriented parallel to one another in each of which a respective second wire runs and is embedded when said coupling unit is mounted on said wire basket;

said first channel crossing said at least two second channels; and said coupling unit having a counter-stop, a further first wire having one side being adjacent said counter-stop when said coupling unit is mounted on said wire basket, and said further first wire being distant from said first channel.

2. The assembly according to claim 1, wherein said coupling unit is formed as a single piece.

3. The assembly according to claim 1, wherein said coupling unit is formed as a separate adapter.

4. The assembly according to claim 1, wherein:

said second wire has a diameter;

said second channels each have a channel axis running along a second channel axis direction;

said second channels each have a second channel opening running in said second channel axis direction; and said second channel openings are narrower at least in parts than said diameter of said second wire.

5. The assembly according to claim 1, wherein each second wire is latched into a respective one of said second channels.

6. The assembly according to claim 4, which further comprises elastic wings delimiting said second channel openings.

7. The assembly according to claim 1, wherein said first channel and said second channels cross at a channel crossing.

8. The assembly according to claim 1, wherein said wires oriented in said first and second directions are disposed crosswise to one another and are connected to one another at crossing points.

9. A domestic refrigeration appliance, comprising:

a housing;

a receiving chamber disposed in said housing for receiving food; and an assembly according to claim 1 being disposed in said receiving chamber, said assembly permitting said wire basket to be pulled out of and pushed back into said receiving chamber.

10. An assembly for a domestic refrigeration appliance, the assembly comprising:

a wire basket having first wires oriented in a first direction and second wires oriented in a second direction being different than said first direction; and at least one pull-out rail apparatus connected to said wire basket, said at least one pull-out rail apparatus having a coupling unit engaging at least partially around one of said first wires oriented in said first direction and engaging at least partially around one of said second wires oriented in said second direction;

said coupling unit having at least one first channel in which said first wire runs and is embedded when said coupling unit is mounted on said wire basket;

said coupling unit having at least two second channels oriented parallel to one another in each of which a respective second wire runs and is embedded when said coupling unit is mounted on said wire basket;

said at least one first channel crossing said at least two second channels; and said coupling unit having a counter-stop, a further first wire having one side being adjacent said counter-stop when said coupling unit is mounted on said wire basket, said further first wire having a side being opposite to said one side and being distant from said at least one first channel, said counter-stop being a plate-shaped strip covering a groove having a bottom opening for suspending and resting said coupling unit on said further first wire.

* * * * *